US010633860B2

(12) United States Patent
Martter

(10) Patent No.: US 10,633,860 B2
(45) **Date of Patent: *Apr. 28, 2020**

(54) REINFORCING ASSEMBLIES HAVING DOWNWARDLY-EXTENDING WORKING MEMBERS ON STRUCTURALLY REINFORCING BARS FOR CONCRETE SLABS OR OTHER STRUCTURES

(71) Applicant: Richard P. Martter, Dallas, TX (US)

(72) Inventor: Richard P. Martter, Dallas, TX (US)

(73) Assignee: Conbar Systems LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/152,830

(22) Filed: Oct. 5, 2018

(65) Prior Publication Data

US 2019/0032336 A1 Jan. 31, 2019

Related U.S. Application Data

(63) Continuation of application No. 15/646,331, filed on Jul. 11, 2017, now Pat. No. 10,119,276.
(Continued)

(51) Int. Cl.
*E04H 12/00* (2006.01)
*E04C 5/06* (2006.01)
(Continued)

(52) U.S. Cl.
CPC ..... *E04C 5/0645* (2013.01); *E04B 5/32* (2013.01); *E04B 5/43* (2013.01)

(58) Field of Classification Search
None
See application file for complete search history.

(56) References Cited

U.S. PATENT DOCUMENTS 943,402 A 12/1909 Ferguson
1,119,123 A 12/1914 Schoenthaler
(Continued)

FOREIGN PATENT DOCUMENTS

DE 2612929 A1 9/1977

OTHER PUBLICATIONS

International Search Report and Written Opinion of the International Searching Authority dated Sep. 11, 2017 in connection with International Patent Application No. PCT/US2017/041660, 7 pages.
(Continued)

*Primary Examiner* — Basil S Katcheves

(57) ABSTRACT

In one aspect, a reinforcing assembly includes one or more longitudinally-extending bars having a first end, a second end opposite the first end, and a midpoint between the first and second ends. The reinforcing assembly also includes multiple downwardly-extending working members each independently connected to at least one of the one or more bars. The working members are oriented diagonally with respect to a longitudinal axis extending along the one or more bars. The working members connected to the one or more bars between the first end and the midpoint are angled in a different direction than the working members connected to the one or more bars between the second end and the midpoint.

20 Claims, 7 Drawing Sheets

Related U.S. Application Data

(60) Provisional application No. 62/363,168, filed on Jul. 15, 2016, provisional application No. 62/436,134, filed on Dec. 19, 2016.

(51) Int. Cl.
*E04B 5/32* (2006.01)
*E04B 5/43* (2006.01)

(56) References Cited

U.S. PATENT DOCUMENTS 1,467,741 A 9/1923 Tubbs
1,620,501 A 3/1927 Vogel
1,930,957 A 10/1933 Nester
2,319,050 A 5/1943 Fischer et al.
2,420,860 A 5/1947 Burner
2,552,365 A 5/1951 Bradbury
2,783,695 A 3/1957 De Canio
2,829,572 A 4/1958 Vanek
2,864,289 A 12/1958 De Canio
3,104,600 A 9/1963 White
3,283,458 A * 11/1966 Gersovitz ..... E04C 5/0645 52/251
3,302,360 A * 2/1967 Bjerking ..... E04C 5/02 52/253
3,400,508 A 9/1968 Dietner et al.
3,693,311 A * 9/1972 Bjerking ..... E04C 5/04 52/677
3,863,416 A 2/1975 Oroschakoff
3,914,915 A * 10/1975 van Schyndel ..... E04C 5/04 52/414
4,128,980 A 12/1978 Abdallah
4,228,625 A 10/1980 Ruffer et al.
4,406,103 A 9/1983 Ghali et al.
4,578,916 A 4/1986 Witschi
4,612,747 A 9/1986 Andra et al.
4,689,867 A 9/1987 Tolliver
4,865,781 A 9/1989 Jennings
4,996,816 A 3/1991 Wiebe
5,235,791 A 8/1993 Yaguchi
5,448,866 A 9/1995 Saito et al.
5,655,349 A 8/1997 Ghali et al.
5,815,999 A 10/1998 Williams
5,992,123 A 11/1999 Kies
6,003,281 A 12/1999 Pilakoutas
6,019,546 A 2/2000 Ruiz
6,052,962 A 4/2000 Ghali et al.
6,092,960 A 7/2000 McCallion
6,171,016 B1 1/2001 Pauls et al.
6,210,070 B1 4/2001 Shaw et al.
D445,668 S 7/2001 Hills, Sr.
6,327,832 B1 12/2001 Ernst et al.
6,385,930 B1 5/2002 Broms et al.
7,281,357 B2 10/2007 Femminella
7,404,691 B2 7/2008 Bennett et al.
7,540,121 B2 6/2009 Haeussler
7,784,235 B2 8/2010 Cretti
7,886,498 B2 2/2011 Baruh
8,220,219 B2 7/2012 Martter
8,549,813 B2 10/2013 Martter
10,119,276 B2 * 11/2018 Martter ..... E04B 5/32
2003/0154674 A1 8/2003 Matthaei et al.
2006/0137282 A1 6/2006 Anvick
2008/0263978 A1 10/2008 Abou-Saleh
2009/0165421 A1 7/2009 Baruh
2009/0188201 A1 7/2009 Ghali et al.
2010/0170194 A1 7/2010 Leone
2011/0094182 A1 4/2011 Kim
2012/0137618 A1 6/2012 Martter
2012/0137619 A1 6/2012 Martter

OTHER PUBLICATIONS

Written Opinion of International Searching Authority dated Apr. 19, 2012 in connection with International Patent Application No. PCT/US2011/63299, 5 pages.
"Fabricated Rebar, Typical Rebar Bends, Standard Rebar Bend Dimensions", retrieved from http://www.nunesconst.com/uploads/Standard_Rebar_Bends.pdf, Jan. 2010, 2 pages.
International Search Report dated Dec. 17, 2014 in connection with International Patent Application No. PCT/US2014/053219, 2 pages.
Written Opinion of the International Searching Authority dated Dec. 17, 2014 in connection with International Patent Application No. PCT/US2014/053219, 5 pages.
Hawkins et al., "Application of LRFD Bridge Design Specifications to High-Strength Structural Concrete: Shear Provisions", vol. 579, Trans. Research Board, 2007, 14 pages.
Office Action dated Dec. 13, 2011 in connection with U.S. Appl. No. 12/959,912, 9 pages.
Mattock, "Shear Transfer in Concrete Having Reinforcement at an Angle to the Shear Plane", 1973, p. 17-42.
Ritchie et al., "Seismic-Resistant Connections of Edge Columns with Prestressed Slabs", ACI Structural Journal, vol. 102, No. 2, Mar.-Apr. 2005, 10 pages.
Ghali, "An Efficient Solution to Punching of Slabs", Concrete International, 1989, p. 50-54.
Saleh et al., "Punching Shear Capacity of Post-Tensioned Slab with Hairpin Shaped Reinforcements", PTI Journal, Jul. 2007, p. 39-48.
Elgabry et al., "Design of Stud-Shear Reinforcement for Slabs", ACI Structural Journal, vol. 87, No. 3, May-Jun. 1990, 12 pages.
Hegger et al., "New reinforcement technology (Part 1)", Reinforcement Technology, Aug. 2008, p. 4-13.
"Filigran Girder Systems," www.filigran.de, exact date unknown (but prior to Jul. 15, 2016), 11 pages.
Office Action dated Sep. 9, 2011 in connection with U.S. Appl. No. 12/959,912, 9 pages.
International Search Report dated Apr. 19, 2012 in connection with International Patent Application No. PCT/US2011/63299, 2 pages.

* cited by examiner

REINFORCING ASSEMBLIES HAVING DOWNWARDLY-EXTENDING WORKING MEMBERS ON STRUCTURALLY REINFORCING BARS FOR CONCRETE SLABS OR OTHER STRUCTURES

CROSS-REFERENCE TO RELATED APPLICATIONS AND PRIORITY CLAIM

This application claims priority under 35 U.S.C. § 120 as a continuation of U.S. patent application Ser. No. 15/646,331 filed on Jul. 11, 2017, which claims priority under 35 U.S.C. § 119(e) to U.S. Provisional Patent Application No. 62/363,168 filed on Jul. 15, 2016 and U.S. Provisional Patent Application No. 62/436,134 filed on Dec. 19, 2016. All of these applications are hereby incorporated by reference in their entirety.

This application is related to U.S. patent application Ser. No. 14/016,998 filed on Sep. 3, 2013, U.S. patent application Ser. No. 13/187,311 filed on Jul. 20, 2011 (now U.S. Pat. No. 8,549,813), and U.S. patent application Ser. No. 12/959,912 filed on Dec. 3, 2010 (now U.S. Pat. No. 8,220,219). These patents and patent applications are also hereby incorporated by reference in their entirety.

TECHNICAL FIELD

This disclosure relates generally to reinforcing structures. More specifically, this disclosure relates to reinforcing assemblies having downwardly-extending working members on structurally reinforcing bars for concrete slabs or other structures.

BACKGROUND

Commercial concrete is a mixture of cement, sand, and stone aggregate that, after the addition of water, slowly hardens together into a rigid structure. Stresses within concrete structures are typically of three primary types: compressive (where particles are crushed together), tensile (where particles are pulled apart), and shear (where one section of a structure is pressured to slide upon an adjacent section).

Unreinforced concrete structures often have good resistance to compressive stresses. However, any significant tensile stresses tend to cause undesirable cracking and separation since concrete is relatively weak in tension. To address this problem, concrete structures are typically reinforced by embedding smaller solid members made of material(s) with high strength in tension. Typically, the smaller members include round steel bars with roughened surfaces, often called "reinforcing steel," "reinforcing bar," or "rebar." Reinforced concrete structures are available commercially in many shapes and sizes, such as slabs, beams, footings, and flat foundations.

Unfortunately, in some concrete structures, shear forces can be concentrated, and a condition called "diagonal tension" is created. When a flat concrete slab (such as a concrete floor slab) is suspended and supported by columns (usually of concrete), the weight of the slab and the load that the slab supports are transferred to the columns through relatively small zones of concrete surrounding the columns. Each of these zones is subject to (i) vertical shear forces resulting from the weight and load of the slab and (ii) internal horizontal shear stress resulting from high bending moments in that area. The combination of high vertical shear stress and high horizontal shear stress creates diagonal tension stress in areas around the columns. Diagonal tension stress is problematic because concrete is particularly weak in tension and the diagonal orientation of potential crack zones makes it difficult for typical rebar installation patterns to work effectively. Also, the relatively thin vertical dimension of the concrete slab can limit the length of rebar that can be used, further reducing its effectiveness.

For this reason, supported concrete structures are typically reinforced in the areas around columns or other supporting structures using short smooth vertical steel studs to provide reinforcement. This is done to prevent tensile failure, crack propagation, and consequent structural collapse. However, conventional approaches often provide reinforcement that helps restrain or minimize cracking or breaking only after the cracking or breaking has been initiated. These conventional approaches are typically unable to prevent cracking or breaking from occurring in the first instance. As a result, the concrete and steel studs generally operate sequentially rather than together. That is, the concrete carries much of the load until cracks occur, at which point significantly all of the load is transferred to the steel studs in the cracked area(s) of the concrete.

SUMMARY

This disclosure provides reinforcing assemblies having downwardly-extending working members on structurally reinforcing bars for concrete slabs or other structures.

In a first aspect, a reinforcing assembly includes one or more longitudinally-extending bars having a first end, a second end opposite the first end, and a midpoint between the first and second ends. The reinforcing assembly also includes multiple downwardly-extending working members each independently connected to at least one of the one or more bars. The working members are oriented diagonally with respect to a longitudinal axis extending along the one or more bars. The working members connected to the one or more bars between the first end and the midpoint are angled in a different direction than the working members connected to the one or more bars between the second end and the midpoint.

In a second aspect, a reinforcing assembly includes multiple longitudinally-extending bars configured to provide structural reinforcement within a structure. The bars collectively have a first end, a second end opposite the first end, and a midpoint between the first and second ends. The reinforcing assembly also includes multiple working members each independently connected to at least one of the bars. The working members are oriented diagonally with respect to a longitudinal axis extending along the bars. The working members connected to at least one of the bars between the first end and the midpoint are angled in a different direction than the working members connected to at least one of the bars between the second end and the midpoint.

In a third aspect, a reinforcing assembly includes multiple longitudinally-extending bars configured to provide structural reinforcement within a structure. The bars collectively have a first end, a second end opposite the first end, and a midpoint between the first and second ends. The reinforcing assembly also includes multiple working members each independently connected to the bars. The working members are oriented diagonally with respect to a longitudinal axis extending along the bars. The working members connected to the bars between the first end and the midpoint extend from the bars away from the midpoint. The working members connected to the bars between the second end and the midpoint extend from the bars away from the midpoint. The working members connected to the bars between the first end and the midpoint are angled in a different direction than the working members connected to the bars between the second end and the midpoint.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 8, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

For simplicity and clarity, some features and components are not explicitly shown in every figure, including those illustrated in connection with other figures. It will be understood that all features illustrated in the figures may be employed in any of the embodiments described in this patent document. Omission of a feature or component from a particular figure is for purposes of simplicity and clarity and not meant to imply that the feature or component cannot be employed in the embodiment(s) described in connection with that figure.

Figure 1:
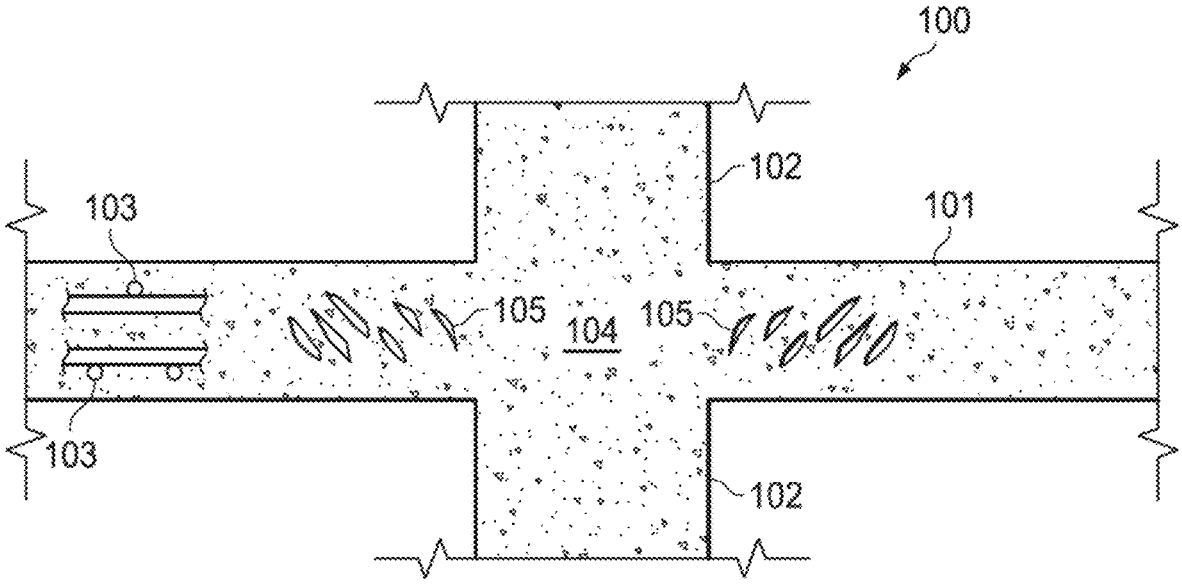
FIG. 1 illustrates an example of a cross-sectional view of a supported structure at an intersection with a supporting structure according to this disclosure.

FIG. 1 illustrates an example of a cross-sectional view 100 of a supported structure at an intersection with a supporting structure according to this disclosure. FIG. 1 also shows the typical location of diagonal tension cracking in the supported structure. In this example, a slab structure 101 (the supported structure) is attached to a support column 102 (the supporting structure). The slab structure 101 can be formed from any suitable material(s), such as concrete or steel-reinforced concrete. The column 102 can also be formed from any suitable material(s), such as concrete or steel-reinforced concrete. Each of the slab structure 101 and the support column 102 could have any suitable size, shape, and dimensions. In some embodiments, the slab structure 101 could have a thickness of about six inches to about twelve inches and the support column 102 could be about sixteen inches to about twenty-four inches square, although other dimensions could be used.

The slab structure 101 typically includes internal structural components that provide reinforcement. These internal components can represent any suitable structure(s) formed from any suitable material(s), such as reinforcing bar ("rebar") 103 formed of carbon steel or other material(s). The rebar 103 can be placed down the length of the slab structure 101 and/or across the width of the slab structure 101 and is generally placed in the vicinity of the support column 102. In some embodiments, the rebar 103 extends across the top of the slab structure 101 (into and out of the view as shown), as well as across the bottom of the slab structure 101. However, both may not be needed, such as when rebar 103 is used across only the top of the slab structure 101.

In this example, a load or "reaction" area 104 of the slab structure 101 represents an area where large upward forces can exist, creating punching shear stresses in the slab structure 101. Here, the punching shear stresses are creating undesirable diagonal tension cracks 105 in the slab structure 101. The cracks 105 can form particularly in areas of high stress of the slab structure 101. Many times, the cracks 105 can form generally in the middle area of the slab structure 101 and can propagate upward and downward, often in a diagonal direction, if not impeded. As described in more detail below, various reinforcing assemblies are disclosed here that can help to reduce or even eliminate the formation of cracks caused by shear forces in a slab structure 101 or other similarly supported structure.

Although FIG. 1 illustrates one example of a cross-sectional view 100 of a supported structure at an intersection with a supporting structure, various changes may be made to FIG. 1. For example, each of the components in FIG. 1 could have any suitable size, shape, and dimensions. Also, the reinforcing assemblies described below could be used in any other environment where shear forces affect a structure, such as with any suitable supported structure that is supported by any suitable supporting structure.

Figure 2:
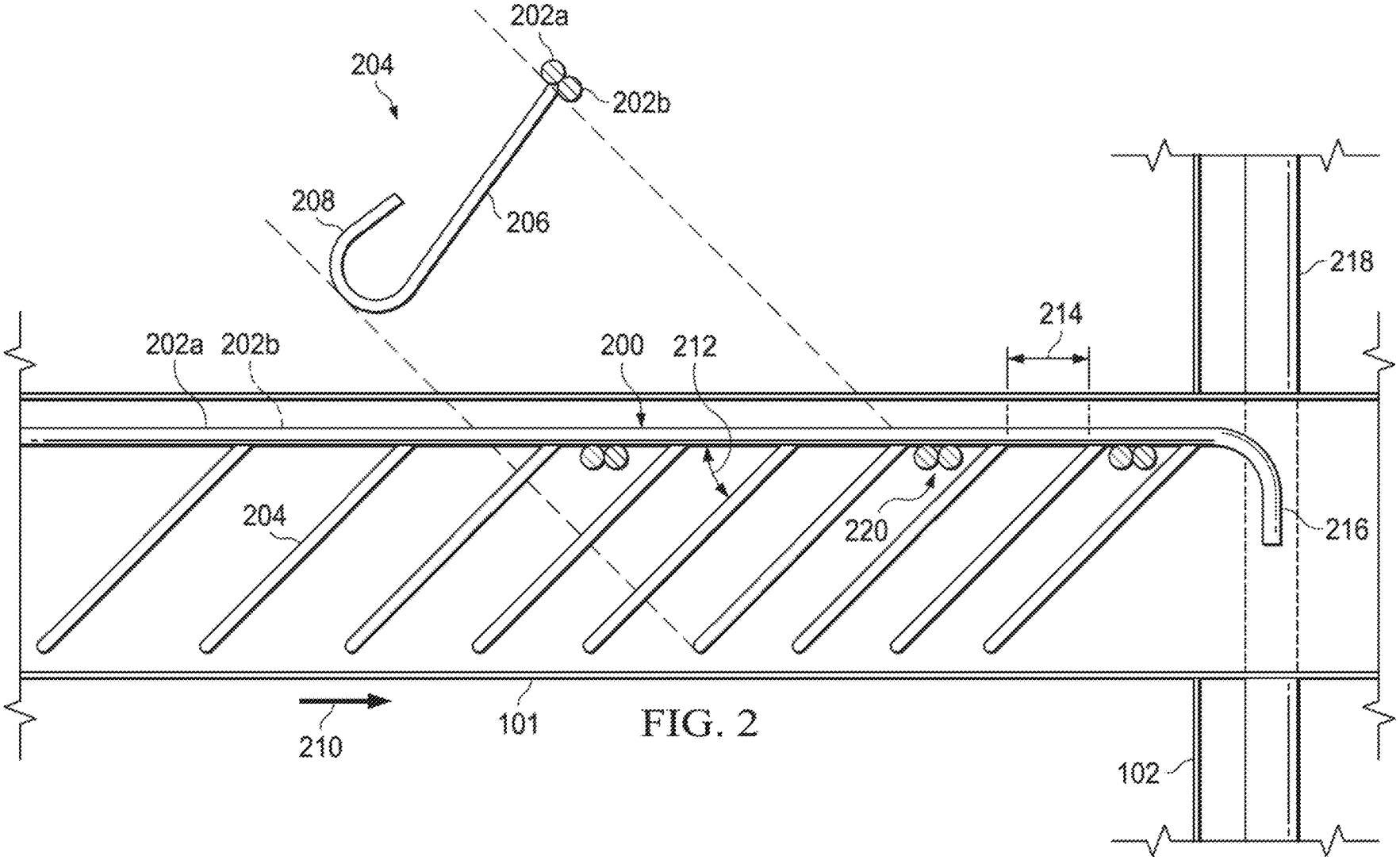
FIGS. 2 and 3 illustrate a first example of a reinforcing assembly according to this disclosure.
Figure 3:
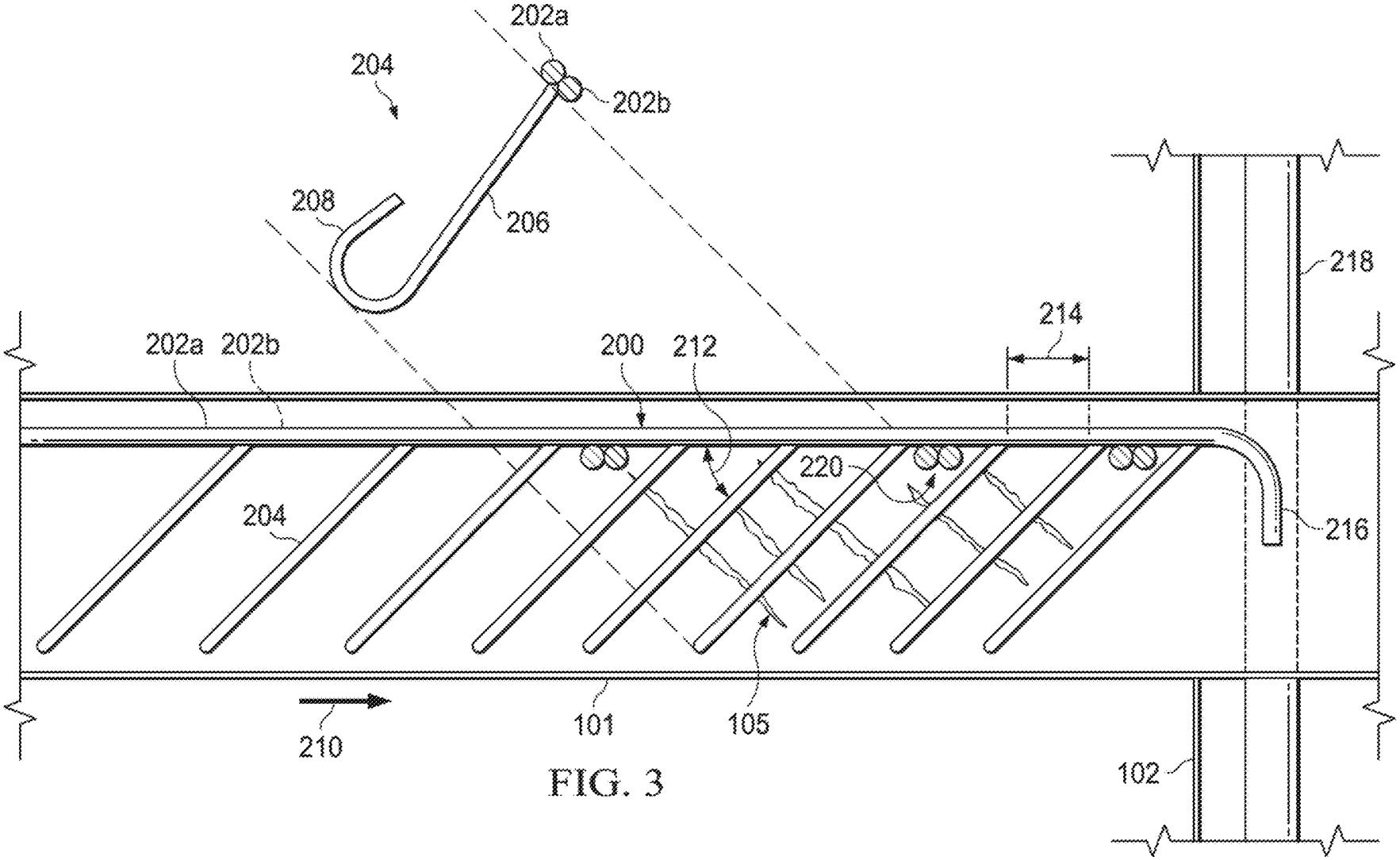

FIGS. 2 and 3 illustrate a first example of a reinforcing assembly 200 according to this disclosure. In these figures and the following description, it is assumed that the reinforcing assembly 200 is used in conjunction with the slab structure 101 and the support column 102 of FIG. 1. However, the reinforcing assembly 200 could be used with any other supported structure or any other supporting structure.

As shown in FIG. 2, the reinforcing assembly 200 includes multiple adjacent longitudinally-extending reinforcement, carrier, or support bars 202*a*-202*b* (referred to as support bars 202). In some embodiments, each of the support bars 202 could represent a single continuous bar, although support bars 202 formed from multiple connected segments could be used. Each of the support bars 202 could have any suitable cross-sectional shape, and each of the support bars 202 could be formed from any suitable material(s), such as rebar. In some embodiments, each of the support bars 202 is formed using #4 or #5 rebar. The support bars 202 could have ribbed, knurled, or other roughened surfaces along their entire lengths. The support bars 202 could be connected to each other, such as via structural welding, along their entire lengths or at specified points along their lengths. The use of multiple support bars 202 instead of a single larger support bar could be advantageous, such as by providing a wider horizontal footprint that furnishes a larger bearing area. However, a single support bar 202 could also be used.

Multiple working members 204 are independently connected to the support bars 202. Each working member 204 here denotes a structure that is connected to the support bars 202, such as via structural welding, and that extends downward and away from the support bars 202. Each of the working members 204 could have any suitable cross-sectional shape, and each of the working members 204 could be formed from any suitable material(s), such as rebar. In some embodiments, each of the working members 204 is formed using #3 rebar. The working members 204 could have ribbed, knurled, or other roughened surfaces along their entire lengths.

In some embodiments, the support bars 202 are welded together (side-to-side) only at the points where the working members 204 are connected to the support bars 202, although other approaches could also be used. Moreover, in some instances, the entire reinforcing assembly 200 can be fabricated using only rebar (possibly only two sizes of rebar) with welded connections.

As shown in FIG. 2, each of the working members 204 includes a downwardly-extending side 206 and a hooked end portion 208. The top end of the downwardly-extending side 206 connects to the support bars 202, while the hooked end portion 208 remains free. The top end of the downwardly-extending side 206 could be connected to equal portions of the support bars 202, unequal portions of the support bars 202, or even to a single one of the support bars 202. The upper tip of the downwardly-extending side 206 could be connected to the support bars 202, or an upper portion of the downwardly-extending side 206 could be bent to run parallel to the support bars 202 and be connected to the support bars 202 along that upper portion.

The hooked end portion 208 denotes a portion of the downwardly-extending side 206 that is bent back. In this example, the hooked end portion 208 is bent by at least 180°, although any suitable amount of bend could be used to form the hooked end portion 208 (such as at least 90°, at least 225°, or at least 270°). Also, the hooked end portion 208 may or may not be curved along its entire length. In FIG. 2, for instance, part of the hooked end portion 208 is more straight than curved, although this need not be the case.

The hooked end portions 208 of adjacent working members 204 can hook in alternate or opposite directions. In FIG. 2, for instance, the hooked end portion 208 of the first working member 204 could hook into the page, the hooked end portion 208 of the second working member 204 could hook out of the page, the hooked end portion 208 of the third working member 204 could hook into the page, the hooked end portion 208 of the fourth working member 204 could hook out of the page, and so on.

The downwardly-extending side 206 of each working member 204 could have any suitable length, and the hooked end portion 208 of each working member 204 could have any suitable size and radius of curvature. In some embodiments, the hooked end portion 208 of each working member 204 has a radius of curvature of about one inch. Note that in this example, the downwardly-extending side 206 and the hooked end portion 208 of each working member 204 form a substantially planar working member 204, although this need not be the case.

As shown in FIG. 2, each working member 204 is oriented diagonally with respect to a longitudinal axis 210 that extends along the support bars 202. Through this diagonal orientation, the working members 204 can more effectively impede diagonal crack formation and propagation in the slab structure 101 and possibly even prevent the formation of cracks 105. An angle 212 between each working member 204 and the support bars 202 could have any suitable value, such as about 20° to about 70°. In particular embodiments, the angle 212 is about 35° or about 45°. The angle 212 could be substantially the same for all working members 204 so that the working members 204 are substantially parallel with each other when the reinforcing assembly 200 is viewed from its side, although this need not be the case.

In some embodiments, the working members 204 are positioned so that at least some of the working members 204 overlap one another when the reinforcing assembly 200 is viewed from its side. In other words, these working members 204 are arranged so that, when the reinforcing assembly 200 is viewed from its side, part of one working member 204 is located over part of a neighboring working member 204 in a direction perpendicular to the longitudinal axis 210 of the support bars 202. The "side" view of the reinforcing assembly 200 is defined here as the view in which the support bars 202 extend left to right and the working members 204 extend downward from the support bars 202.

A spacing 214 between the working members 204 could be consistent along the length of the reinforcing assembly 200, or the spacing 214 between the working members 204 could vary. In some embodiments, the spacings 214 between adjacent pairs of working members 204 along the length of the reinforcing assembly 200 vary in different sections or vary continuously along the length of the reinforcing assembly 200. For instance, adjacent pairs of working members 204 closer to the support column 102 could have smaller spacings 214, while adjacent pairs of working members 204 farther from the support column 102 could have larger spacings 214. In particular embodiments, the smallest horizontal spacing 214 between two adjacent working members 204 could be about three to about four inches, and the largest spacing 214 between two adjacent working members 204 could be about ten inches.

The spacing(s) 214 and the length(s) of the working members 204 for any particular installation could be based on various factors. Example factors include the thickness of the slab structure 101, the load to be placed on the slab structure 101, the strength of the concrete or other material(s) forming the slab structure 101, and the size of the column 102. In general, any technique for increasing or decreasing the spacings 214 between at least some of the adjacent pairs of working members 204 along the length of the reinforcing assembly 200 could be used. Note that the use of smaller spacings 214 closer to the column 102 allows the reinforcing assembly 200 to provide greater reinforcement closer to the support column 102. However, variable spacing is not required in the reinforcing assembly 200.

As shown in FIG. 2, each support bar 202 can optionally include a section 216 that terminates within the column 102 and that is bent. The sections 216 of the support bars 202 are designed to extend into the support column 102 and optionally into a column reinforcement 218 (such as support rebar) to provide additional support and gripping action in an area of maximum stress and load transfer. Note that the size and shape of each section 216 could vary as needed or desired.

The reinforcing assembly 200 is shown here as being used in conjunction with additional reinforcement 220. The additional reinforcement 220 could denote the rebar 103 or other materials providing normal reinforcement within the slab structure 101. As can be seen here, the spacing(s) 214 of the working members 204 can be selected so that the working members 204 are located in areas where the additional reinforcement 220 is not.

As shown in FIG. 2, each of the working members 204 can be bent a single time before, during, or after being connected to the support bars 202. Automated machinery could be used to bend the rebar or other materials to form the working members 204 and to weld or otherwise attach the working members 204 to the support bars 202.

As shown in FIG. 3, the working members 204 are placed diagonally on the support bars 202 to engage any nascent crack 105 in the slab structure 101 at a 90° or near 90° angle with respect to the crack 105 itself. This provides improved or maximum efficiency in terms of aligning the working members 204 to directly oppose the diagonal tension (splitting) forces. With diagonal placement, each working member 204 engages a much larger percentage of the potential crack zone per unit length as compared to a vertical orientation. The diagonal placement also enables each working member 204 to engage up to twice as many crack zones per unit. Further, the compact size and alignment of the working members 204 allow the working members 204 to penetrate downward, even between densely-packed top rebar concentrations, and to engage the full depth of structural slab thickness.

Although the use of small (roughened) rebar could mean that more working members are required per installation, this provides an advantage in that it allows a more dispersed distribution of the individual working members in concrete than is provided by conventional approaches. As a result, the reinforcing can "blend" into the concrete material and act more as an integral part of the concrete itself.

Figure 4:
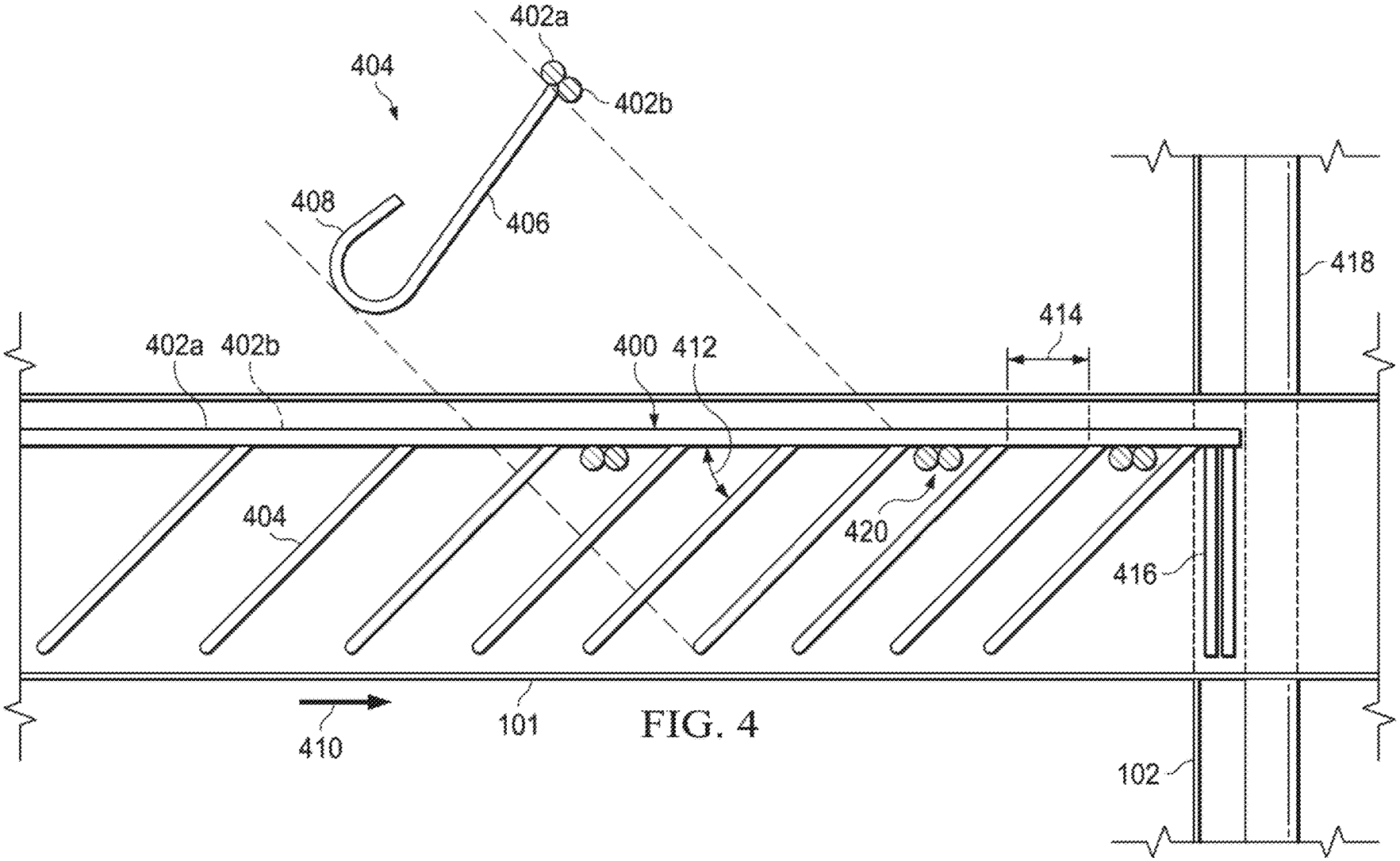
FIG. 4 illustrates a second example of a reinforcing assembly according to this disclosure.

FIG. 4 illustrates a second example of a reinforcing assembly 400 according to this disclosure. As shown in FIG. 4, the reinforcing assembly 400 includes multiple adjacent longitudinally-extending reinforcement, carrier, or support bars 402*a*-402*b* (referred to as support bars 402). Note, however, that a single support bar 402 could also be used.

Multiple working members 404 are independently connected to the support bars 402. Each of the working members 404 includes a downwardly-extending side 406 and a hooked end portion 408, and the hooked end portions 408 of adjacent working members 404 can hook in alternate or opposite directions. The downwardly-extending side 406 could be connected to one or both support bars 402 (equally or unequally). The hooked end portion 408 may or may not be curved along its entire length, and in this example part of the hooked end portion 408 is more straight than curved.

Each working member 404 is oriented diagonally with respect to a longitudinal axis 410 that extends along the support bars 402. An angle 412 between each working member 404 and the support bars 402 could have any suitable value, such as about 20° to about 70°. In particular embodiments, the angle 412 is about 35° or about 45°. The same angle 412 may or may not be used for each working member 404.

A spacing 414 between the working members 404 could be consistent or vary. If a variable spacing 414 is used, the spacings 414 could vary in sections or continuously along the length of the reinforcing assembly 400. Each longitudinally-extending support bar 402 can optionally terminate at the column 102 in a structure 416. This structure 416 is designed to extend into the support column 102 and may or may not extend into a column reinforcement 418 (such as support rebar). The reinforcing assembly 400 can be used in conjunction with additional reinforcement 420. The components 402-414, 418-420 shown in FIG. 4 could be the same as or similar to the corresponding components 202-214, 218-220 in FIGS. 2 and 3.

Rather than representing bent portions of the support bars 402, the structure 416 includes one or more additional components that are connected to the support bars 402. For example, the structure 416 here can be formed by connecting one or more downwardly-extending bars to the support bars 402. The downwardly-extending bars could be formed of #3, #4, or #5 rebar or other structures that are welded or otherwise secured to the support bars 402. Note that while the structure 416 is shown as extending straight down in FIG. 4, this need not be the case. For instance, the structure 416 could extend downward and then angle back out of the column 102 and into the slab structure 101.

In some embodiments, the working members 404 are positioned so that at least some of the working members 404 overlap one another when the reinforcing assembly 400 is viewed from its side. In other words, these working members 404 are arranged so that, when the reinforcing assembly 400 is viewed from its side, part of one working member 404 is located over part of a neighboring working member 404 in a direction perpendicular to the longitudinal axis 410 of the support bars 402. The "side" view of the reinforcing assembly 400 is defined here as the view in which the support bars 402 extend left to right and the working members 404 extend downward from the support bars 402.

Figure 5:
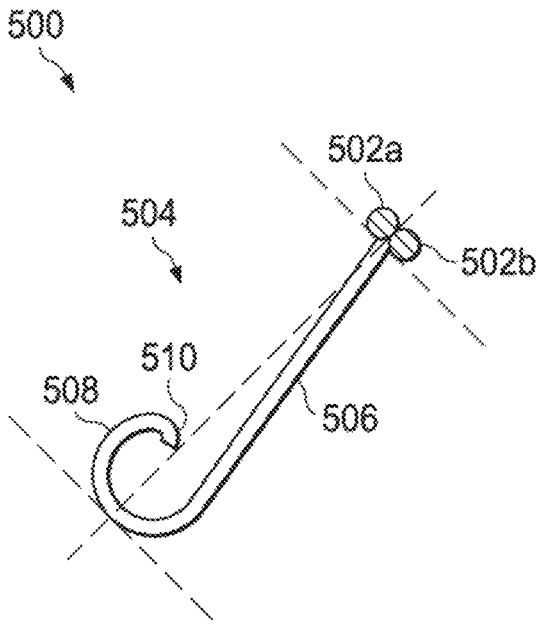
FIG. 5 illustrates a third example of a reinforcing assembly according to this disclosure.

FIG. 5 illustrates a third example of a reinforcing assembly 500 according to this disclosure. In the following description, it is assumed that the reinforcing assembly 500 is used in conjunction with the slab structure 101 and the support column 102 of FIG. 1. However, the reinforcing assembly 500 could be used with any other supported structure or any other supporting structure.

As shown in FIG. 5, the reinforcing assembly 500 includes multiple reinforcement, carrier, or support bars 502*a*-502*b* (referred to as support bars 502) and multiple working members 504 arranged on the support bars 502. Note, however, that a single support bar 502 could also be used. Each working member 504 includes a downwardly-extending side 506 and a hooked end portion 508. These components could be the same as or similar to the corresponding components described above, except that the hooked end portion 508 hooks by at least 270° here. Note that while part of the hooked end portion 508 is more straight than curved, this need not be the case. Although not shown, in some embodiments, the working members 504 are positioned so that at least some of the working members 504 overlap one another when the reinforcing assembly 500 is viewed from its side.

Figure 6:
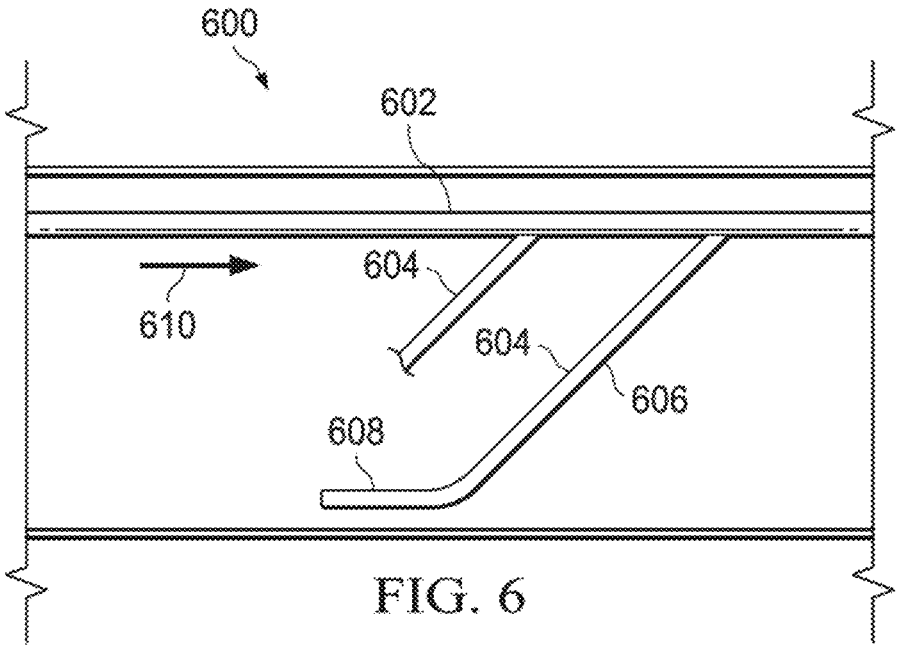
FIG. 6 illustrates a fourth example of a reinforcing assembly according to this disclosure.

FIG. 6 illustrates a fourth example of a reinforcing assembly 600 according to this disclosure. In the following description, it is assumed that the reinforcing assembly 600 is used in conjunction with the slab structure 101 and the support column 102 of FIG. 1. However, the reinforcing assembly 600 could be used with any other supported structure or any other supporting structure.

As shown in FIG. 6, the reinforcing assembly 600 includes at least one reinforcement, carrier, or support bar 602 (referred to as support bar(s) 602) and multiple working members 604 arranged on the support bar(s) 602. Each working member 604 includes a downwardly-extending side 606 and a hooked end portion 608.

In this example, a single support bar 602 could be used in the reinforcing assembly 600, although multiple support bars 602 could be used as described above. Also, the hooked end portion 608 of each working member 604 here can be bent at a smaller angle, such as an angle of at least 45°, although other angles including the ones described above could be used. In addition, each working member 604 can be bent so that the hooked end portion 608 extends along a longitudinal axis 610 of the support bar(s) 602 (away from a column 102), rather than extending traverse to the longitudinal axis 610 of the support bar(s) 602. Any individual one of these features or any combination of these features could be used in the reinforcing assemblies 200, 400, 500 described above. Although not shown, in some embodiments, the working members 604 are positioned so that at least some of the working members 604 overlap one another when the reinforcing assembly 600 is viewed from its side.

Figure 7:
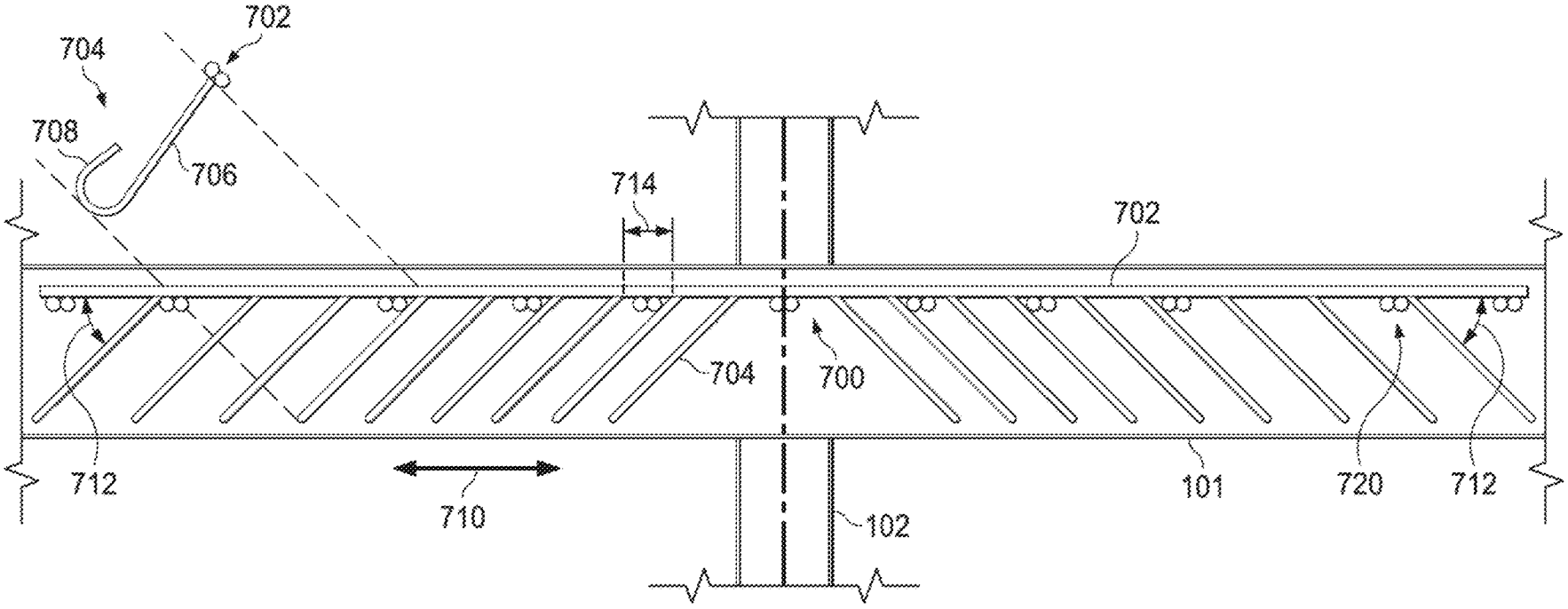
FIG. 7 illustrates a fifth example of a reinforcing assembly according to this disclosure.

FIG. 7 illustrates a fifth example of a reinforcing assembly 700 according to this disclosure. In FIG. 7 and the following description, it is assumed that the reinforcing assembly 700 is used in conjunction with the slab structure 101 and the support column 102 of FIG. 1. However, the reinforcing assembly 700 could be used with any other supported structure or any other supporting structure.

As shown in FIG. 7, the reinforcing assembly 700 includes one or more longitudinally-extending reinforcement, carrier, or support bars 702 (referred to as support bar(s) 702). In some embodiments, each support bar 702 could represent a single continuous bar, although a support bar 702 formed from multiple connected segments could be used. Each of the support bars 702 could have any suitable cross-sectional shape, and each of the support bars 702 could be formed from any suitable material(s), such as rebar. In some embodiments, each of the support bars 702 is formed using #4 or #5 rebar. In particular embodiments, the support bars 702 could denote negative moment reinforcing bars used in a concrete slab or other structure. The support bars 702 could have ribbed, knurled, or other roughened surfaces along their entire lengths. If multiple adjacent support bars 702 (such as two adjacent support bars 702) are used, the support bars 702 could be connected to each other, such as via structural welding, along their entire lengths or at specified points along their lengths. The use of multiple support bars 702 instead of a single larger support bar could be advantageous, such as by providing a wider horizontal footprint that furnishes a larger bearing area.

Multiple working members 704 are independently connected to the support bars 702. Each working member 704 here denotes a structure that is connected to the support bars 702, such as via structural welding, and that extends downward and away from the support bars 702. Each of the working members 704 could have any suitable cross-sectional shape, and each of the working members 704 could be formed from any suitable material(s), such as rebar. In some embodiments, each of the working members 704 is formed using #3 rebar. The working members 704 could have ribbed, knurled, or other roughened surfaces along their entire lengths.

In some embodiments, the support bars 702 could denote structures that are already going to be used within the slab structure 101 or other supported structure, such as when the support bars 702 represent negative moment reinforcing bars. In those types of embodiments, the working members 704 could be added to the support bars 702 (typically but not necessarily in a shop) and may represent the only addition required to implement the reinforcing assembly 700 in the slab structure 101.

Also, in some embodiments, multiple support bars 702 are welded together (side-to-side) only at the points where the working members 704 are connected to the support bars 702, although other approaches could also be used. Moreover, in some instances, the entire reinforcing assembly 700 can be fabricated using only rebar (possibly only two sizes of rebar) with welded connections.

As shown in FIG. 7, each of the working members 704 includes a downwardly-extending side 706 and a hooked end portion 708. The top end of the downwardly-extending side 706 connects to the support bars 702, while the hooked end portion 708 remains free. Note, however, that the working members 704 could have any other suitable designs that allow the working members 704 to extend downward from the bar(s) 702 and provide reinforcement. For instance, the working members 704 could have the form shown in FIG. 5 or FIG. 6.

The top end of the downwardly-extending side 706 could be connected to equal portions of the support bars 702, unequal portions of the support bars 702, or even to a single one of the support bars 702. The upper tip of the downwardly-extending side 706 could be connected to the support bars 702, or an upper portion of the downwardly-extending side 706 could be bent to run parallel to the support bars 702 and be connected to the support bars 702 along that upper portion.

The hooked end portion 708 denotes a portion of the downwardly-extending side 706 that is bent back. In this example, the hooked end portion 708 is bent by at least 180°, although any suitable amount of bend could be used to form the hooked end portion 708 (such as at least 45°, as at least 90°, at least 225°, or at least 270°). Also, the hooked end portion 708 may or may not be curved along its entire length. In FIG. 7, for instance, part of the hooked end portion 708 is more straight than curved, although this need not be the case.

The hooked end portions 708 of adjacent working members 704 can hook in alternate or opposite directions. In FIG. 7, for instance, the hooked end portion 708 of the first working member 704 could hook into the page, the hooked end portion 708 of the second working member 704 could hook out of the page, the hooked end portion 708 of the third working member 704 could hook into the page, the hooked end portion 708 of the fourth working member 704 could hook out of the page, and so on.

The downwardly-extending side 706 of each working member 704 could have any suitable length, and the hooked end portion 708 of each working member 704 could have any suitable size and radius of curvature. In some embodiments, the hooked end portion 708 of each working member 704 has a radius of curvature of about one inch. Note that in this example, the downwardly-extending side 706 and the hooked end portion 708 of each working member 704 form a substantially planar working member 704, although this need not be the case.

As shown in FIG. 7, each working member 704 is oriented diagonally with respect to a longitudinal axis 710 that extends along the support bars 702. Through this diagonal orientation, the working members 704 can more effectively impede diagonal crack formation and propagation in the slab structure 101 and possibly even prevent the formation of cracks 105. An angle 712 between each working member 704 and the support bars 702 could have any suitable value, such as about 20° to about 70°. In particular embodiments, the angle 712 is about 35° or about 45°. The angle 712 could be substantially the same for different sets of working members 704 so that the working members 704 in each set are substantially parallel with each other when the reinforcing assembly 700 is viewed from its side, although this need not be the case.

In the example shown in FIG. 7, the support bars 702 do not terminate at or within the support column 102. Instead, the support bars 702 start some distance from the support column 102, travel through or near the support column 102, and terminate some distance from the support column 102. Because the support bars 702 extend in opposite directions from the support column 102, the working members 704 on opposite ends of the support column 102 are angled in opposite directions. That is, working members 704 on the left end of the support bars 702 in FIG. 7 angle downward and to the left away from the support column 102, while working members 704 on the right end of the support bars 702 in FIG. 7 angle downward and to the right away from the support column 102. The angles used by the right and left working members 704 may be the same or could vary as needed or desired. In particular embodiments, one half of the reinforcing assembly 700 is a mirror-image of the other half of the reinforcing assembly 700.

The reinforcing assembly 700 could be fabricated in any suitable manner. For example, the reinforcing assembly 700 could be constructed by welding or otherwise attaching the working members 704 to one or more continuous support bars 702. As another example, separate reinforcing assemblies (such as any of the reinforcing assemblies described above) could be welded or otherwise attached together at their support bars 702.

In some embodiments, the working members 704 are positioned so that at least some of the working members 704 overlap one another when the reinforcing assembly 700 is viewed from its side. In other words, these working members 704 are arranged so that, when the reinforcing assembly 700 is viewed from its side, part of one working member 704 is located over part of a neighboring working member 704 in a direction perpendicular to the longitudinal axis 710 of the support bars 702. The "side" view of the reinforcing assembly 700 is defined here as the view in which the support bars 702 extend left to right and the working members 704 extend downward from the support bars 702.

A spacing 714 between adjacent working members 704 could be consistent along the length of the reinforcing assembly 700 (except in a central area where the support bars 702 pass through the support column 102), or the spacings 714 between adjacent working members 704 could vary. In some embodiments, the spacings 714 between adjacent pairs of working members 704 along the length of the reinforcing assembly 700 vary in different sections or continuously moving out from a center of the reinforcing assembly 700. For instance, adjacent pairs of working members 704 closer to the support column 102 could have smaller spacings 714, while adjacent pairs of working members 704 farther from the support column 102 could have larger spacings 714. In particular embodiments, the smallest horizontal spacing 714 between two adjacent working members 704 could be about three to about four inches, and the largest spacing 714 between two adjacent working members 704 could be about ten inches.

The spacing(s) 714 and the length(s) of the working members 704 for any particular installation could be based on various factors. Example factors include the thickness of the slab structure 101, the load to be placed on the slab structure 101, the strength of the concrete or other material(s) forming the slab structure 101, and the size of the column 102. In general, any technique for increasing or decreasing the spacings 714 between at least some of the adjacent pairs of working members 704 along the length of the reinforcing assembly 700 could be used. The use of smaller spacings 714 closer to the column 102 allows the reinforcing assembly 700 to provide greater reinforcement closer to the support column 102. However, variable spacing is not required in the reinforcing assembly 700.

As noted above, the one or more support bars 702 here could denote one or more negative moment reinforcing bars, which are often found in concrete slabs or other structures. In these embodiments, the working members 704 could be secured to some or all of the negative moment reinforcing bars in the area of a support column 101.

The reinforcing assembly 700 is shown here as being used in conjunction with additional reinforcement 720. The additional reinforcement 720 could denote the rebar 103 or other materials providing normal reinforcement within the slab structure 101. As can be seen here, the spacing(s) of the working members 704 can be selected so that the working members 704 are located in areas where the additional reinforcement 720 is not.

As shown in FIG. 7, each of the working members 704 could be bent a single time before, during, or after being connected to the support bars 702. Automated machinery could be used to bend the rebar or other materials to form the working members 704 and to weld or otherwise attach the working members 704 to the support bars 702.

The working members 704 can be placed diagonally on the support bars 702 to engage any nascent crack 105 in the slab structure 101 at a 90° or near 90° angle with respect to the crack 105 itself. This provides improved or maximum efficiency in terms of aligning the working members 704 to directly oppose the diagonal tension (splitting) forces. With diagonal placement, each working member 704 engages a much larger percentage of the potential crack zone per unit length as compared to a vertical orientation. The diagonal placement also enables each working member 704 to engage up to twice as many crack zones per unit. Further, the compact size and alignment of the working members 704 allow the working members 704 to penetrate downward, even between densely-packed top rebar concentrations, and to engage the full depth of structural slab thickness.

Although the use of small (roughened) rebar could mean that more working members are required per installation, this provides an advantage in that it allows a more dispersed distribution of the individual working members in concrete than is provided by conventional approaches. As a result, the reinforcing can "blend" into the concrete material and act more as an integral part of the concrete itself.

Figure 8:
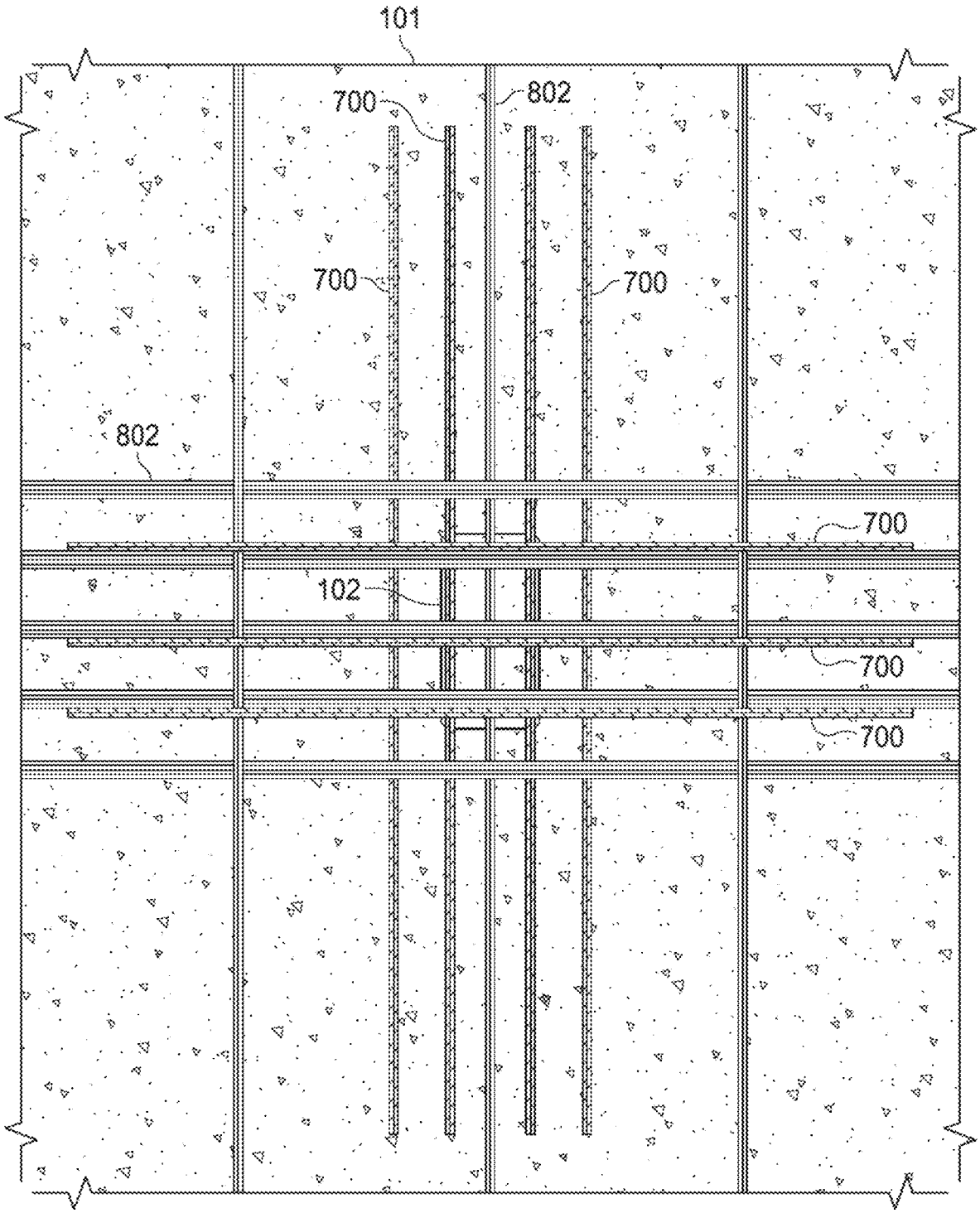
FIG. 8 illustrates a top view of an example use of a reinforcing assembly according to this disclosure.

FIG. 8 illustrates a top view of an example use of a reinforcing assembly 700 according to this disclosure. As shown here, multiple reinforcing assemblies 700 are used within the slab structure 101, and some of the reinforcing assemblies 700 extend through the area where the support column 102 joins the slab structure 101. Given the rectangular size of the support column 102 in this particular example, different numbers of reinforcing assemblies 700 can be used in different directions through the slab structure 101 (although this need not be the case).

There are also multiple instances of post-tensioned cables 802 extending through the slab structure 101 and the support column 102 in different directions. The post-tensioned cables 802 are routinely used in concrete slabs or other structures to provide reinforcement against tensile stresses.

Note that in this example, there are reinforcing assemblies 700 extending through the slab structure 101 both through the area where the support column 102 joins the slab structure 101 and next to the area where the support column 102 joins the slab structure 101. Also note that this occurs in different directions through the slab structure 101. However, this need not be the case. For example, while there are four reinforcing assemblies 700 traveling up and down in FIG. 8, the outer two reinforcing assemblies 700 traveling up and down in FIG. 8 could be omitted so that only the two inner reinforcing assemblies 700 traveling up and down in FIG. 8 remain. Those two inner reinforcing assemblies 700 pass through the area where the support column 102 joins the slab structure 101. Any other numbers and arrangements of reinforcing assemblies 700 could be used in the slab structure 101.

During use, the reinforcing assemblies 200, 400, 500, 600, 700 in FIGS. 2 through 7 may operate as follows. The working members 204, 404, 504, 604, 704 of a reinforcing assembly transmit horizontal and vertical forces within a slab structure 101 up to the support bar(s) 202, 402, 502, 602, 702. These horizontal and vertical forces are respectively axial with and transverse to the support bars. The support bars are designed to resist moving in response to these horizontal and vertical forces. As a result, the support bars transmit these forces to the upper zone of the slab structure 101 and then to the column 102, possibly into the rebar or other column reinforcement 218, 418 within the column 102. Effectively, the reinforcing assembly operates to "pick up" downward loads within the slab structure 101 and carry those loads into the column 102, helping to reduce the vertical loads on the slab structure 101.

The ability to transmit horizontal and vertical forces within a slab structure 101 into the support bars is different from how various conventional approaches operate. For example, steel studs (such as in the STUD-RAIL system) are not designed to capture and transmit horizontal forces into support bars and are instead designed to provide vertical reinforcement within a slab. Moreover, horizontal flat bars in systems like the STUD-RAIL system are smooth and are not used to resist horizontal forces on the flat bars. In addition, vertical studs such as in the STUD-RAIL system are not designed to grip concrete along their entire lengths but are instead designed to include smooth shafts that connect upper and lower flanges together. When diagonal cracks begin to form, the load of the concrete is transferred to the flanges and then to the shafts of the vertical studs, and the shafts can actually elongate. As a result, when cracks due to diagonal tension stresses begin to form, the fractured surfaces can slip along the smooth shafts, and the cracks extend into longer and wider cracks. These wider cracks can be particularly detrimental to the integrity of the overall structure because they could lead to a condition known as "loss of aggregate interlock," which allows differential slippage between the surfaces to occur and a failure sequence to begin.

In contrast, the reinforcing assemblies in FIGS. 2 through 7 can be formed from materials such as rebar that can grip adjacent concrete, and the working members can be arranged substantially perpendicular to any cracks or potential cracks. Thus, the reinforcing assemblies can significantly reduce cracking and can significantly impede further cracking if cracks do form. Moreover, if cracks do form, the rough surfaces of the cracks can be held close together by the reinforcing assemblies, allowing the inner surfaces of the cracks to continue to "mate" and reducing or preventing differential slippage. Even if small micro-cracks form, the use of rebar with roughened surfaces helps to prevent wider cracks and a loss of aggregate interlock, thereby helping to prevent a failure sequence from beginning.

In FIGS. 2 through 7, the use of ribbed, knurled, or other roughened surfaces of the various components of the reinforcing assemblies help to bond the reinforcing assemblies to the concrete or other material(s) of the slab structure 101. This helps to inhibit axial movement of the concrete or other material(s) and to inhibit localized formation and separation of cracks. The angled placement of the working members in the reinforcing assemblies allows the working members to be substantially or completely perpendicular to the orientation of anticipated cracks, allowing the working members to provide increased or maximum structural efficiency. Vertical reinforcing structures (such as in the STUD-RAIL system) may be pulled sideways when diagonal cracks form, which could crush the concrete at the edges of the cracks and allow the cracked surfaces to move slightly apart. The angled orientation of the working members also allows working members of longer lengths to be used in the reinforcing assemblies compared to systems in which steel studs (such as in in the STUD-RAIL system) are oriented vertically within a slab. Further, because #3 rebar (with ⅜" diameter) has a smaller cross-sectional area compared to conventional devices (such as ½" diameter steel studs in the STUD-RAIL system), there can be more working members placed in a given space, thereby providing a wider distribution of reinforcement in the reinforcing assemblies. The smaller cross-sectional area of the working members also provides more surface area per pound of material, which helps to provide better bonding efficiency. In addition, the variable spacing of the working members (if used) allows more reinforcement to be provided in areas where punching shear stresses or other stresses are the highest, such as around columns or other supporting structures.

Note that the support bars in the reinforcing assemblies are located on top of the reinforcing assemblies rather than on bottom of the reinforcing assemblies within the slab structure 101. It has been discovered that when a concrete slab undergoes deformation due to punching shear stress, the top of the concrete slab near a column experiences excessive bi-axial tensile stress, while the bottom of the concrete slab near the column experiences excessive compressive stress. If the support bars are located at the bottom of a reinforcing assembly with the working members extending upward, the free ends of the working members may be unable to maintain anchorage with the concrete at the top of the slab due to the excessive bi-axial horizontal tensile stress, which reduces the compressive strength of the concrete in that area.

Arranging the support bars at the top of the reinforcing assemblies allows the support bars to provide tensile reinforcement for the top of the slab structure 101. Also, running multiple support bars together horizontally provides a wider bearing area to support the vertical tensile forces in the working members. Moreover, arranging the support bars at the top of the reinforcing assemblies allows the free ends of the working members to be located near the bottom of the slab structure 101. This is where compressive stress due to bending enhances the compressive strength of the concrete so that it can more efficiently grip the bottom ends of the working members, which can help to maintain a secure bond with the hooked end portions of the working members. This is the opposite of the condition that occurs at the top of the concrete slab.

In addition, the bars and working members of the reinforcing assemblies are often described above as being formed from rebar. However, other material(s) could be used to form the bars and/or working members of the reinforcing assemblies. For example, rather than rebar, each bar and/or working member of a reinforcing assembly could be formed using a "threaded" bar or rod. As a particular example, each bar and/or working member of a reinforcing assembly could be formed using a threaded steel bar or rod. Similar to a bolt or screw, a threaded bar or rod includes at least one thread that wraps around a bar or rod along at least part of the length of the structure. The thread or threads help to engage the concrete around the threaded structure. Such a structure could be fabricated in any suitable manner, such as by machining at least one thread along part or all of the length of a bar or rod. Other types of structures could also be used to form the bars and/or working members, such as other structures having surface characteristics that enable the bars and/or working members to grip or engage concrete.

Although FIGS. 2 through 7 illustrate examples of reinforcing assemblies for use with concrete structures or other supported structures and FIG. 8 illustrates one example use of a reinforcing assembly, various changes may be made to FIGS. 2 through 8. For example, the shapes and relative sizes and dimensions of components in each figure are for illustration only. Also, the number of each component in each figure could vary, such as when more than two support bars are used in a reinforcing assembly or multiple pieces of rebar are used to form a working member. Further, each of the reinforcing assemblies could find use in a number of situations other than the example shown. For instance, one or more reinforcing assemblies can be used with a column, with a beam stirrup of a long-span deep beam, or within a beam stirrup of a wide shallow beam, and multiple reinforcing assemblies could be positioned on each side of a column or other supporting structure.

In addition, any of the features shown or described with respect to one or some of the figures could be used in the other figures, even if not shown or described with respect to the other figures. As a particular example, one or more negative moment reinforcing bars, while described as possibly being used as the support bar(s) 702, could also be used in any of the other reinforcing assemblies described above. As another particular example, while the working members 704 in FIG. 7 are the same as or similar to the working members 204 and 404 in FIGS. 2 through 4, the working members 500 or 600 in FIG. 5 or 6 could be used in FIG. 7. As yet another particular example, any of the reinforcing assemblies shown in FIGS. 2 through 6 could be positioned around the column 102 as shown in FIG. 8, although those reinforcing assemblies may not extend through the column 102 as do the reinforcing assemblies 700.

Note that multiple support bars in the reinforcing assemblies described above may or may not have the same length and/or ends that are aligned with or attached to one another. For example, in some embodiments, one of the support bars could be shorter than the other support bar, or support bars of equal or unequal lengths could be offset from each other. This may allow, for example, one support bar to extend farther away from a column or other supporting structure than the other support bar. As a particular example, one support bar could extend farther away from the column or other supporting structure than the other support bar by about one or two feet. If the support bars extend through the column as in FIG. 7, one support bar could extend farther away from the column or other supporting structure than the other support bar at both ends, or different support bars could extend farther away from the column or other supporting structure on different sides of the column. This may be an option in some cases since the reinforcement that is needed may be less when farther away from the column or other supporting structure, so only one support bar may be needed or desired at those farther distances. Among other things, this could reduce the amount of metal or other materials needed for the support bars. This can be particularly beneficial in large structures when hundreds or thousands of the reinforcing assemblies may be needed.

A particular use of the reinforcing assemblies described in this document could be as follows (of course, other uses are possible). Two types of flexural stresses are typically present in an elevated concrete slab on either side of a loaded support member, typically a concrete column, or a drop panel. One is horizontal flexural tension in the upper portion of the slab due to negative bending moments. The other is diagonal (to the horizontal direction) tension due to the interaction between vertical shear stresses resulting from the slab load and horizontal shear stress caused by flexural bending. Current practice for flexural tension reinforcement is to use straight rebar distributed or tied in bundles at the top of the slab.

Horizontal tensile stresses may be at a maximum immediately adjacent to the column and can diminish moving away from the column. The vertical shear due to gravity loads could interact with horizontal bending shear and deflect some of that stress into a diagonal alignment, which could lead to diagonal tension. In other words, high bending stresses do not simply disappear as they move away from the column but may actually curve downward. The tension created by this curvature is accommodated using tensile reinforcement, which can be provided by the welded or other connections to the support bars at the top ends of the working members in the reinforcing assemblies. The reinforcing assemblies can therefore uniquely provide continuous reinforcement to substantially match the pattern of stress in the slab.

Diagonal tension stresses tend to cause cracks in a direction diagonal to the horizontal axis of the slab. The working members can be positioned perpendicular or substantially perpendicular to the orientation of the cracks as described above to provide reinforcement. However, since the working members are diagonal to the slab thickness, the working members might be too short to develop the necessary or desired bond to the surrounding concrete at the top ends of the working members. The top ends of the working members can therefore be welded or otherwise attached to the support bar or bars (possibly made of larger rebar), which serves as an anchorage and helps to eliminate the need for long bond lengths at the top ends. At the bottom ends of the working members, anchorage is provided by the loops or hooks, which can be sufficient since the concrete at the bottom of the slab is under bi-axial compression and therefore does not need normal bond lengths to develop its strength. The support bars at the top of the slab continue to engage the bending moment tensile stresses in the top of the slab.

The welded connections between the support bars and the working members can provide a continuous and essentially curved pattern of tensile reinforcement throughout a stressed area. These welded connections allow the horizontal support bars to maintain their primary function as reinforcement for tensile stress, such as due to negative bending near the supporting column, while also serving as an anchorage to the top ends of the diagonal working members. Ordinarily, the design of rebar assumes that tensile stresses are in straight alignment. When the tensile stresses are deflected from a straight line, the rebar deflects accordingly in order to be effective, but curvature of rebar creates stress concentrations at the point of curvature and requires lateral anchorage at that point. The welded or other connections of the working members to the support bars provide a unique and efficient solution to this condition. Simply hooking the working members at their top ends has proven to be ineffective in various use scenarios.

It may be advantageous to set forth definitions of certain words and phrases used throughout this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A reinforcing assembly comprising:

one or more longitudinally-extending bars having a first end, a second end opposite the first end, and a midpoint between the first and second ends; and multiple downwardly-extending working members each independently connected at a top of the working member to at least one of the one or more bars, the working members oriented diagonally with respect to a longitudinal axis extending along the one or more bars;

wherein the working members connected to the one or more bars between the first end and the midpoint are angled in a different direction than the working members connected to the one or more bars between the second end and the midpoint.

2. The reinforcing assembly of claim 1, wherein:

the working members connected to the one or more bars between the first end and the midpoint are substantially parallel with each other when the reinforcing assembly is viewed from a side; and the working members connected to the one or more bars between the second end and the midpoint are substantially parallel with each other when the reinforcing assembly is viewed from the side.

3. The reinforcing assembly of claim 1, wherein the longitudinal axis extending along the one or more bars is substantially straight.

4. The reinforcing assembly of claim 1, wherein:

the one or more bars comprise multiple bars, and the bars are connected to each other.

5. The reinforcing assembly of claim 4, wherein the bars are welded to each other only at locations where the working members are connected to the bars.

6. The reinforcing assembly of claim 1, wherein:

the one or more bars comprise multiple bars; and the multiple bars are offset so that (i) ends of the bars are not aligned and (ii) the bars collectively have the first end, the second end opposite the first end, and the midpoint between the first and second ends.

7. The reinforcing assembly of claim 1, wherein:

the one or more bars comprise multiple bars; and at least some of the working members are connected to all of the bars.

8. The reinforcing assembly of claim 1, wherein each working member comprises a downwardly-extending side and a hooked or bent portion at an end of the downwardly-extending side.

9. The reinforcing assembly of claim 1, wherein:

the one or more bars are configured to engage bending moment tensile stresses in a supported structure; and the working members are configured to extend down into a central portion of the supported structure to engage diagonal tension stresses.

10. A reinforcing assembly comprising:

multiple longitudinally-extending bars connected to one another along lengths of the bars and configured to provide structural reinforcement within a structure, the bars collectively having a first end, a second end opposite the first end, and a midpoint between the first and second ends; and multiple working members each independently connected at a top of the working member to at least one of the bars, the working members oriented diagonally with respect to a longitudinal axis extending along the bars;

wherein the working members connected to at least one of the bars between the first end and the midpoint are angled in a different direction than the working members connected to at least one of the bars between the second end and the midpoint.

11. The reinforcing assembly of claim 10, wherein:

the working members connected to at least one of the bars between the first end and the midpoint are substantially parallel with each other when the reinforcing assembly is viewed from a side; and the working members connected to at least one of the bars between the second end and the midpoint are substantially parallel with each other when the reinforcing assembly is viewed from the side.

12. The reinforcing assembly of claim 10, wherein the longitudinal axis extending along the bars is substantially straight.

13. The reinforcing assembly of claim 10, wherein no working member is connected to the bars at and adjacent to the midpoint.

14. The reinforcing assembly of claim 10, wherein the bars are welded to each other only at locations where the working members are connected to at least one of the bars.

15. The reinforcing assembly of claim 10, wherein the multiple bars are offset so that ends of the bars are not aligned.

16. The reinforcing assembly of claim 10, wherein at least some of the working members are connected to all of the bars.

17. The reinforcing assembly of claim 10, wherein each working member comprises a downwardly-extending side and a hooked or bent portion at an end of the downwardly-extending side.

18. The reinforcing assembly of claim 10, wherein:

the bars are configured to engage bending moment tensile stresses in a supported structure; and the working members are configured to extend down into a central portion of the supported structure to engage diagonal tension stresses.

19. The reinforcing assembly of claim 10, wherein the bars comprise negative moment reinforcing bars.

20. A reinforcing assembly comprising:

multiple longitudinally-extending bars welded to one another along lengths of the bars and configured to provide structural reinforcement within a structure, the bars collectively having a first end, a second end opposite the first end, and a midpoint between the first and second ends; and multiple working members each independently connected at a top of the working member to the bars, the working members oriented diagonally with respect to a longitudinal axis extending along the bars;

wherein the working members connected to the bars between the first end and the midpoint extend downward from the bars away from the midpoint;

wherein the working members connected to the bars between the second end and the midpoint extend downward from the bars away from the midpoint; and wherein the working members connected to the bars between the first end and the midpoint are angled in a different direction than the working members connected to the bars between the second end and the midpoint.

* * * * *